US009945649B2

(12) United States Patent
Malul et al.

(10) Patent No.: US 9,945,649 B2
(45) Date of Patent: Apr. 17, 2018

(54) SYSTEM AND METHOD FOR GUIDING A CANNON SHELL IN FLIGHT

(75) Inventors: Assaf Malul, Jerusalem (IL); Ziv Moshkovitz, Ein Ayala (IL)

(73) Assignee: BAE SYSTEMS ROKAR INTERNATIONAL LTD., Jerusalem (IL)

( * ) Notice: Subject to any disclaimer, the term of this patent is extended or adjusted under 35 U.S.C. 154(b) by 559 days.

(21) Appl. No.: 13/216,467

(22) Filed: Aug. 24, 2011

(65) Prior Publication Data

US 2012/0048992 A1 Mar. 1, 2012

(30) Foreign Application Priority Data

Aug. 25, 2010 (IL) ..... 207800

(51) Int. Cl.
*F42B 10/14* (2006.01)
*F42B 10/64* (2006.01)

(52) U.S. Cl.
CPC ..... *F42B 10/14* (2013.01); *F42B 10/64* (2013.01)

(58) Field of Classification Search
CPC ..... F42B 10/14; F42B 10/64; F42B 10/54; F42B 10/62; F42B 15/01; F42B 10/02; F42B 10/26
USPC ..... 244/3.21–3.29
See application file for complete search history.

(56) References Cited

U.S. PATENT DOCUMENTS 3,111,088 A * 11/1963 Fisk ..... 244/3.23
3,968,945 A * 7/1976 Walton ..... 244/3.28
4,512,537 A 4/1985 Sebestyen et al.
4,568,039 A 2/1986 Smith et al.
5,393,011 A * 2/1995 Dunn et al. ..... 244/3.21
5,423,497 A * 6/1995 Ransom ..... 244/3.22
6,360,987 B1 3/2002 Sallaee et al.
6,869,044 B2 * 3/2005 Geswender et al. ..... 244/3.29
(Continued)

FOREIGN PATENT DOCUMENTS

DE 10 2005 0358 2/2007
DE 3347941 6/2007
(Continued)

OTHER PUBLICATIONS

Office Action of Israel Application No. 207800 dated Dec. 9, 2013.
(Continued)

*Primary Examiner* — Valentina Xavier
(74) *Attorney, Agent, or Firm* — Pearl Cohen Zedek Latzer Baratz LLP

(57) ABSTRACT

An apparatus and method for guiding a cannon shell accurately are disclosed. The apparatus includes two main parts adapted to be installed on the leading end of the cannon shell. The front main part of the apparatus is equipped with at least one pair of fins and is rotatable with respect to the rear main part. The pair of fins is controlled to hold the front main part substantially stable with respect to an external reference frame when the cannon shell rotates as it flies towards its target. Control system is comprised within the apparatus that receives location signals and is adapted to provide guiding control commands to the cannon shell via the fins so as to guide the shell accurately to its preprogrammed target. The control system is adapted to activate the detonation chain of the shell according to preprogrammed mode.

15 Claims, 13 Drawing Sheets

(56) References Cited

U.S. PATENT DOCUMENTS

| | | | | |
|---|---|---|---|---|
| 6,981,672 | B2 | 1/2006 | Clancy et al. | |
| 7,354,017 | B2 * | 4/2008 | Morris et al. | 244/3.23 |
| 7,487,934 | B2 * | 2/2009 | Johnsson | 244/3.29 |
| 7,533,849 | B2 | 5/2009 | Zemany et al. | |
| 7,718,937 | B1 * | 5/2010 | Dunn et al. | 244/3.23 |
| 7,755,012 | B2 * | 7/2010 | Mock | 244/3.23 |
| 8,026,465 | B1 * | 9/2011 | Fraysse, Jr. | 244/3.22 |
| 8,319,163 | B2 | 11/2012 | Flood et al. | |
| 8,426,788 | B2 | 4/2013 | Geswender | |
| 8,513,581 | B2 * | 8/2013 | Geswender et al. | 244/3.24 |
| 8,993,948 | B2 | 3/2015 | Geswender et al. | |
| 9,303,964 | B2 | 4/2016 | Wurzel et al. | |
| 2004/0144888 | A1 * | 7/2004 | Dryer et al. | 244/3.27 |
| 2004/0232278 | A1 * | 11/2004 | Geswender et al. | 244/3.28 |
| 2008/0001023 | A1 * | 1/2008 | Schroeder | 244/3.24 |
| 2008/0029641 | A1 * | 2/2008 | Carlson | F42B 10/64 244/3.24 |
| 2012/0241551 | A1 * | 9/2012 | Rastegar et al. | 244/3.24 |

FOREIGN PATENT DOCUMENTS

| | | |
|---|---|---|
| EP | 1930686 | 6/2008 |
| EP | 1 953 494 | 8/2008 |
| FR | 1257614 | 4/1961 |
| JP | 2010078221 | 4/2010 |
| WO | WO 02/06761 | 1/2002 |
| WO | WO 2010/039322 | 4/2010 |
| WO | WO 2010/083517 | 7/2010 |

OTHER PUBLICATIONS

European Search Report of Application No. EP 11 17 8692 dated Jun. 5, 2015.

Search Report of Application No. EP17180536.9 dated Sep. 28, 2017.

* cited by examiner

SIDE VIEW TOP VIEW

SYSTEM AND METHOD FOR GUIDING A CANNON SHELL IN FLIGHT

CROSS REFERENCE TO RELATED APPLICATIONS

This Application claims the benefit of Israel Application No. 207800, filed on Aug. 25, 2010, which is hereby incorporated by reference in its entirety.

BACKGROUND OF THE INVENTION

Artillery shells fired from canons are known for many years. As much as the canon barrel and other parts of the canon are accurate, the accuracy of the hitting point of the shell is relatively low, and may reach a circular error probability (CEP) of 500 m or more when fired to a range of, for example, 40 kilometers.

SUMMARY OF THE INVENTION

A device and method are presented for the control and correction of the trajectory of a standard artillery shell in order to dramatically improve its circular error probability (CEP), by guiding the artillery shell during its flight using controllable fins to steer the artillery shell while receiving substantially continuous location information, for example from a global positioning system (GPS). The device is designed to replace a standard shell's fuse, by employing a rear portion identical in shape to and comprising at least the same functions as a rear portion of a standard artillery shell fuse. The forward portion of the device is similar to that of a standard fuse in length and general shape but includes, next to the external envelope of the fuse, at least one set of fins, as will be explained herein after.

Embodiments of the invention are designed to substantially stabilize the spin of the fuze's forward end comprising the control fins by allowing mechanical axial disengagement of the front portion of the device from its rear portion to enable free turn of the front portion about the spin axis of the shell and by using the at least one set of fins to produce anti-spin force to suppress the tendency of the forward portion of the device to spin with the main portion of the shell.

Device and method according to embodiments of the present invention may further use the same or another set of fins to steer the shell along a desired trajectory. The description herein below will describe system, device and method of controlling the flight of a cannon shell using two sets of fins, however it will be appreciated by one skilled in the art that according to some embodiments of the present invention one set (e.g. a single pair) of fins may be used for both stabilizing the rotational movement of the front portion of the cannon shell and controlling the lift of the shell, for example by combining the respective movements of the fins to produce, concurrently, anti-rotational stabilizing force and lifting force in the required amount, as is explained in details herein below The additional set of fins may be operated mainly as a pitch control means, thus controlling the actual distance the shell achieves from the cannon to the target. Yet, according to additional embodiments, this set of fins may further be used for steering the shell laterally with respect to a momentary trajectory, for example by allowing, via the control of the roll stabilizing fins, some axial roll of the steering element of the artillery shell with respect to the horizon line and then activating the lift fins to achieve lateral guidance, as is done with a fixed-wing airplane maneuvering sideways turn.

A device and method according to embodiments of the present invention may further comprise safety measures and means to ensure at least minimal flight range and/or time after shooting of the artillery shell before it is armed, to prevent detonation of the artillery shell close to the cannon and to ensure detonation of the artillery shell according to pre-set conditions even if the main controlling circuitry is heavily damaged upon hitting of the ground, the target or any other hard body.

A device and method according to embodiments of the present invention may be designed to survive, and properly operate after the artillery shell has been shot—an operation that imposes an extremely high acceleration factor on the device. Accordingly, two (or more) bearings, which are provided to enable spin-free engagement between the two main parts, front and rear parts, of the device are installed so that when the artillery shell and the device are subject to the extremely high acceleration factors during the shooting of the shell, the axial loads of the device are supported by elements other than the bearing themselves, thus leaving the bearings free of these heavy loads.

According to embodiments of the present invention, a control system of the device may be adapted to receive, before the artillery shell is shot, data such as location of the cannon, location of the target, current weather conditions, etc. The control system of the device may also be adapted to receive and be set to operate according to desired modes of operation, such as detonation above ground, detonation upon hitting the ground, detonation after a pre-set delay from hitting the ground or detonation after a pre-set time from firing. The control system may further comprise means of destroying when it is estimated that the shell actual trajectory is too far from the desired trajectory, and cannot be steered to target. The control system may further comprise the circuitry and mechanics required to operate the two sets of control fins, to operate position receiving system (such as a GPS receiver), and to operate a secured pre-shooting mission loading process.

The control system may be adapted to ensure long off-duty life of its internal power source, such as a battery, a rechargeable battery and the like, by operating a dormant mode with extremely low power consumption, or none at all. The dormant mode may be changed to a partially active mode, for example when mission data is loaded, or to a fully operative mode when, or shortly after, the artillery shell is shot.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
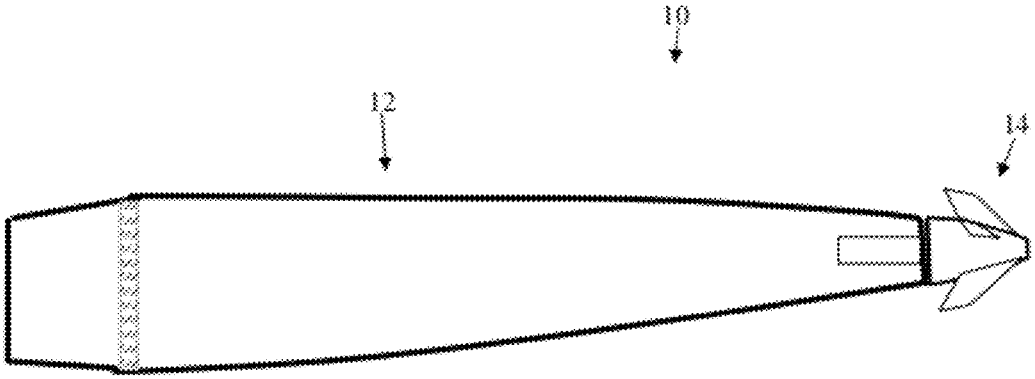
FIGS. 1A and 1B are schematic illustration of an artillery shell and of a guiding device for an artillery shell, respectively, according to embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Figure 1B:
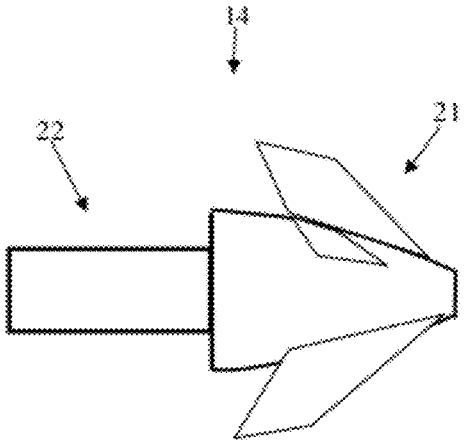

Reference is made now to FIGS. 1A and 1B, which are schematic illustration of artillery shell 10 and of guiding device 14 for a artillery shell, respectively, according to embodiments of the present invention. Artillery shell 10 may comprise any kind of a standard shell body 12 and guiding device 14 installed at its frontal end, substantially employing the installation space of a standard fuse. Guiding device 14 may comprise front portion unit 21 made to protrude in front of shell body 12 and rear portion 22, made to fit into a respective cavity at the front end of shell body 12.

Figure 1C:
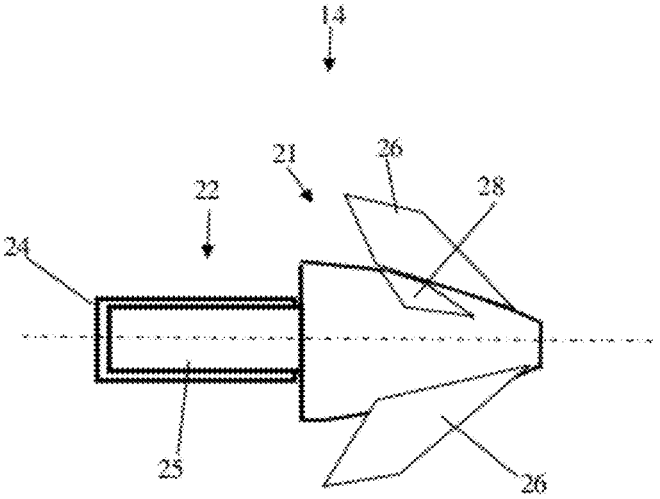
FIG. 1C depicts a schematic illustration of some major elements of a guiding device according to embodiments of the present invention.

Reference is made now also to FIG. 1C, depicting a schematic illustration of some major elements of guiding device 14 according to embodiments of the present invention. Guiding device 14 comprises, at its front portion unit 21, at least one pair of lift fins 26 and optionally one pair of roll stabilizing fins 28. The lift fins may also be used to create a roll-stabilizing effect if rotated in opposition to one another. The fins in each pair may preferably be arranged opposing each other with respect to the main longitudinal axis of guiding device 14, and substantially orthogonal to each other when two pairs only are used. Rear portion 22 of guiding device 14 may comprise external casing 24 and internal casing 25. External casing 24 may be adapted to firmly and tightly be attached, typically by threading but other means are possible, into the cavity of the fuse in standard shell body 12. Internal casing 25 may be firmly connected to front portion unit 21 and mechanically disengaged axially from external casing 24 so that these casings may turn about main longitudinal axis of artillery shell 10 free from each other, for example by means of bearings, as is explained in details below.

Figure 2A:
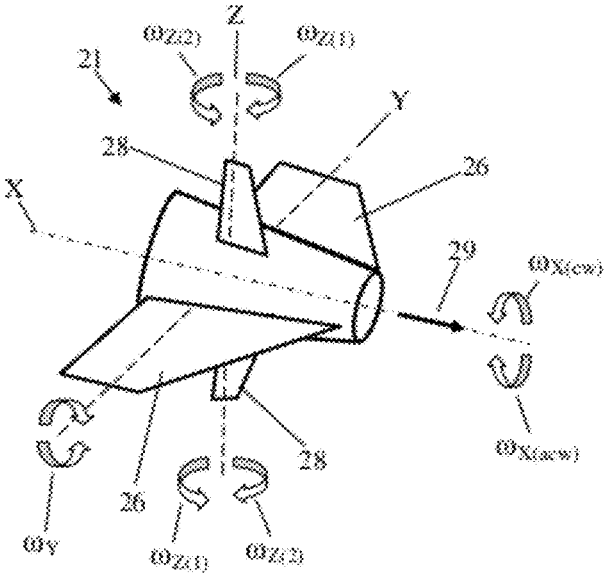
FIGS. 2A and 2B are schematic illustration of the various possible movements of lift fins and roll stabilizing fins and the resulting movements of a guiding device, in isometric and front views, respectively, according to embodiments of the present invention.
Figure 2B:
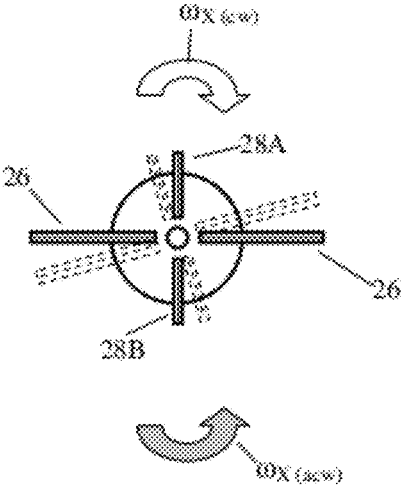

Reference is made now to FIGS. 2A and 2B, which schematically illustrate the various possible movements of lift fins 26 and roll stabilizing fins 28 and the resulting movements of guiding device 14, in isometric and front views, respectively, according to embodiments of the present invention. Three mutually perpendicular imaginary axes X, Y and Z are referred to with respect to front portion unit 21 of guiding device 14. Axis X is aligned with the longitudinal axis of front portion unit 21; axis Y which coincides with the main plane of lift fins 26 and passes substantially through the pivots connecting them to respective driving mechanism (both not shown in these drawings); and axis Z which coincides with the main plane of roll stabilizing fins 28 and passes substantially through the pivots connecting them to respective driving mechanism (both not shown in these drawings). A first driving mechanism is adapted to turn lift fins 26 together about axis Y, that is first and second fins 26 turn together to the same direction about axis Y, as if they are connected firmly to a single pivot. The turn of lift fins about axis Y is symbolized by the two arc-like arrows $\omega_Y$. A second driving mechanism is adapted to turn roll stabilizing fins 28 about axis Z in mutually opposite directions with respect to each other. That is, first roll stabilizing fin 28 turns about axis Z in an opposite direction of second roll stabilizing fin 28, with respect to axis Z. In another embodiment of the present invention, the two lift fins 26 are controlled separately. When rotated in opposing directions to each-other, create a roll action, and when controlled to rotate in the same direction cause a lift action. As indicated above in order to provide a combination of lift and roll actions by a single pair of fins a respective amount of change of the angle of attack of each of the fins of that pair is induced.

After artillery shell 10 is shot it travels through the air along a trajectory. Shortly after the artillery shell leaves the cannon barrel lift fins 26 and roll stabilizing fins 28 become active in a way that is explained in details below. As explained above, front portion unit 21 of guiding device 14 together with internal casing 25 are free to turn with respect to external casing 24, which is firmly connected to shell body 12. Typically shell body 12 turns about its longitudinal axis during its flight due to spin that is given to it by the cannon barrel during the shooting. When artillery shell 10 gains certain distance the cannon lift fins 26 and roll stabilizing fins 28 are operated to stop the spin of front portion unit 21 with respect to an external reference axes frame such as that of the globe. In order to stabilize the spin of front portion unit 21 about axis X roll stabilizing fins 28 may be turned about Z axis so as to gain turning force about X axis in an opposite direction to the direction of the shell's spin. For example, if shell body 10 spins in the direction indicated by arrow $\omega_{X(cw)}$, in order to cancel for front portion unit 21 this roll stabilizing fin 28A may be turned about Z axis in the direction indicated by arrow $\omega_{Z(2)}$) and roll stabilizing fin 28B may be turned about Z axis in the opposite direction. Lift forces developing on roll stabilizing fins 28A, 28B due to their deviation from a neutral angle of attack create a turning force on front portion unit 21 around X axis in the direction indicated by arrow $\omega_{X(acw)}$, opposite to the direction of spin of shell body 12. A proper setting of the angle of attack of roll stabilizing fins 28A, 28B may bring the spin speed of front portion unit 21 around X axis to substantially zero with respect to an external axis frame, such as that of the globe. In a similar manner if a small angle of spin of front portion unit 21 about X axis is desired, e.g. as exemplified by the dashed-line image of fins 26 and 28A, 28B, which is slightly turned with respect to the solid line image of the fins in the direction indicated by arrow $\omega_{X(acw)}$ in FIG. 2B, a momentary turn of fins 28A, 28B in the direction indicated by arrow $\omega_{z(1)}$ will induce a turning force in the desired direction. The amount of change of the angle of attack is derived from the desired speed of effecting the roll movement. When front portion unit 21 reaches the desired angle of roll stabilizing fins 28A, 28B may be returned to their neutralized angle and thus keep the roll angle of front portion unit 21 steady. Lift fins 26 may also be used to control the roll angle of the front portion unit 21 by controlling each fin separately and turning them in opposition to each other.

When front portion unit 21 is stabilized so that its Z axis is substantially constantly parallel to a plane perpendicular to the horizon line, which is having a roll angle equal to zero, lift fins 26 may be used as wings in an airplane for producing lift forces. Assuming that the roll angle of front portion unit 21 is zero, changes in the angle of attack of lift fins 26 with respect to the velocity vector 29 will change the vertical projection of the trajectory of artillery shell 10 due to increase or decrease of the vertical component of the lift force produced on lift fins 26. When the angle of attack of lift fins 26 is increased (i.e. pitch up), the amount of aerodynamic lift power developing on fins 26 increases and thus pushes the trajectory of artillery shell 10 upwards, and vice versa. A neutralized angle of attack may be defined as the angle of attack of fins 26 which does not effect the vertical projection of the trajectory of artillery shell 10. When front portion unit 21 is slightly rolled from the zero roll angle, the direction of the combined lift force on fins 26 is respectively deviated from the normal to the horizon line and as a result the a portion of the combined lift force is directed to the side, thus causing the artillery shell to deviate sideways from its current trajectory.

Figure 2C:
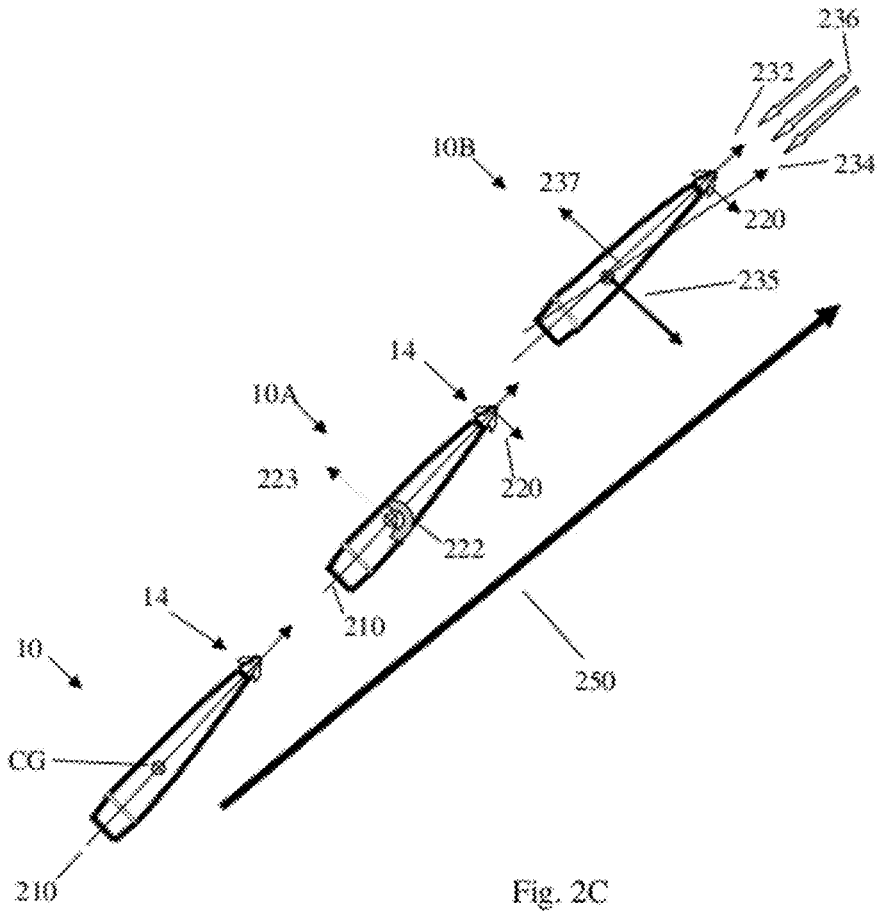
FIG. 2C is a schematic illustration of a method for correcting deviation from a desired trajectory according to embodiments of the present invention.

Reference is made now to FIG. 2C, which is a schematic illustration of a method for correcting deviation from a desired trajectory according to embodiments of the present invention. Artillery shell 10 equipped with a guiding device 14 according to embodiments of the present invention is shot along flight line 250 but deviates from it, as seen in the figure, for example due to initial errors in azimuth or elevation, wind or variations in air density. Artillery shell 10 has a center of gravity located at point CG and it moves momentarily along flight line 210. Due to the deviation of the line of flight of artillery shell 10 from the desired flight line 250 a correction is required. Artillery shell 10A depicts a first step in the process of flight line correction. By proper operation of the fins, e.g. lift fins 26 and roll stabilizing fins 28, a steering force may be produced by guiding device 14, depicted by arrow 220. Steering force 220 causes artillery shell 10A to change its momentary velocity vector towards flight line 250. Artillery shell 10, 10A, 10B spins about its longitudinal axis due to spin grooves in the cannon barrel. This causes a reaction motion depicted by rotation arrow 222 caused by force 220 as a result of the gyroscopic effect of the shell. If an imaginary line 223 is drawn from the shell's CG in parallel but in opposition to the force vector 220, a reaction rotation 222 is created around this line. Artillery shell 10B depicts the second step in the process of flight line correction. Rotation 222 causes various motions of the shell, until shell 10A settles with its body angle mainly opposite to the original force 220 as depicted in shell 10B. Shell body angles described in 10B cause an aerodynamic force 237 which is mainly opposite to the desired direction 220. The balance between the two forces 220 and 237 creates the desired effect of moving shell 10B towards the desired trajectory 250.

Figure 2D:
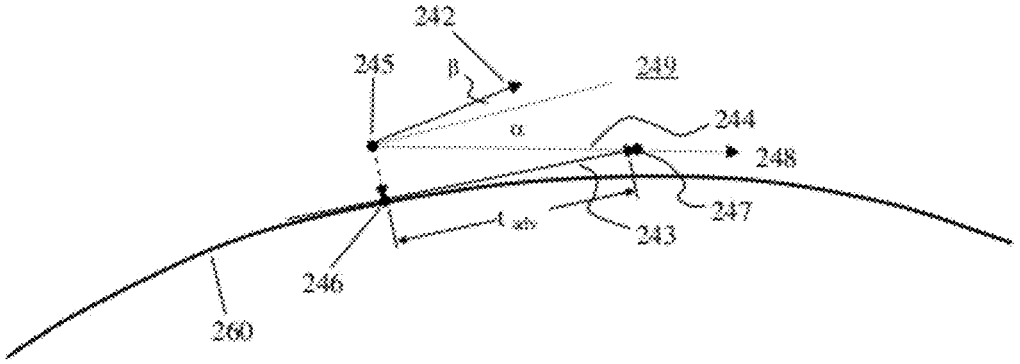
FIG. 2D is a schematic illustration of a method for determining the required momentary correction in the actual flight trajectory when certain deviation from a desired trajectory, according to embodiments of the present invention.

Reference is made now to FIG. 2D, which is a schematic illustration of a method for determining the required momentary correction in the actual flight trajectory when certain deviation from a desired trajectory according to embodiments of the present invention. The momentary location of the artillery shell, at a given moment $t_m$ is depicted by its CG point located at point 245 and its momentary direction of flight is depicted by arrow 242. Given that the location at that moment on the desired trajectory 260 is at point 246. In order to determine the required amount of momentary correction in the direction of flight that the artillery shell should experience, in order to gradually converge to the desired trajectory 260, an imaginary vector line 243 is set. The beginning of vector 243 is at point 246 and its direction is tangent to the trajectory at point 246 thus ending at point 247. The length of vector 243 is set to be $x_{adv}=v_{traj}*t_{adv}$ where $v_{traj}$ is the expected velocity at point 246 of the trajectory, and $t_{adv}$ is either a constant or a number that varies along the trajectory. Line 249 is parallel to line 243 and crates angle $\alpha$ with line 248 and $\beta$ with velocity vector 242. The required correction is set now to be in the direction from current location 245 towards calculated location 247 along line 248, thus inducing a momentary angle of change $\alpha+\beta$ in the direction of flight. It would be apparent to a person skilled in the art that the length of line 243, determined by the parameter $t_{adv}$ , may be set to be longer or shorter, as may be desired, in order to perform a more tight or more relaxed convergence process to desired trajectory line 260, and may change as a function of time during the flight. Further, it would be apparent to a person skilled in the art that while the example given above is made in the 2D dimension, the same principles may be applied in the real, 3D space, with the required modifications, without deviating from the scope of the present invention.

Figure 3:
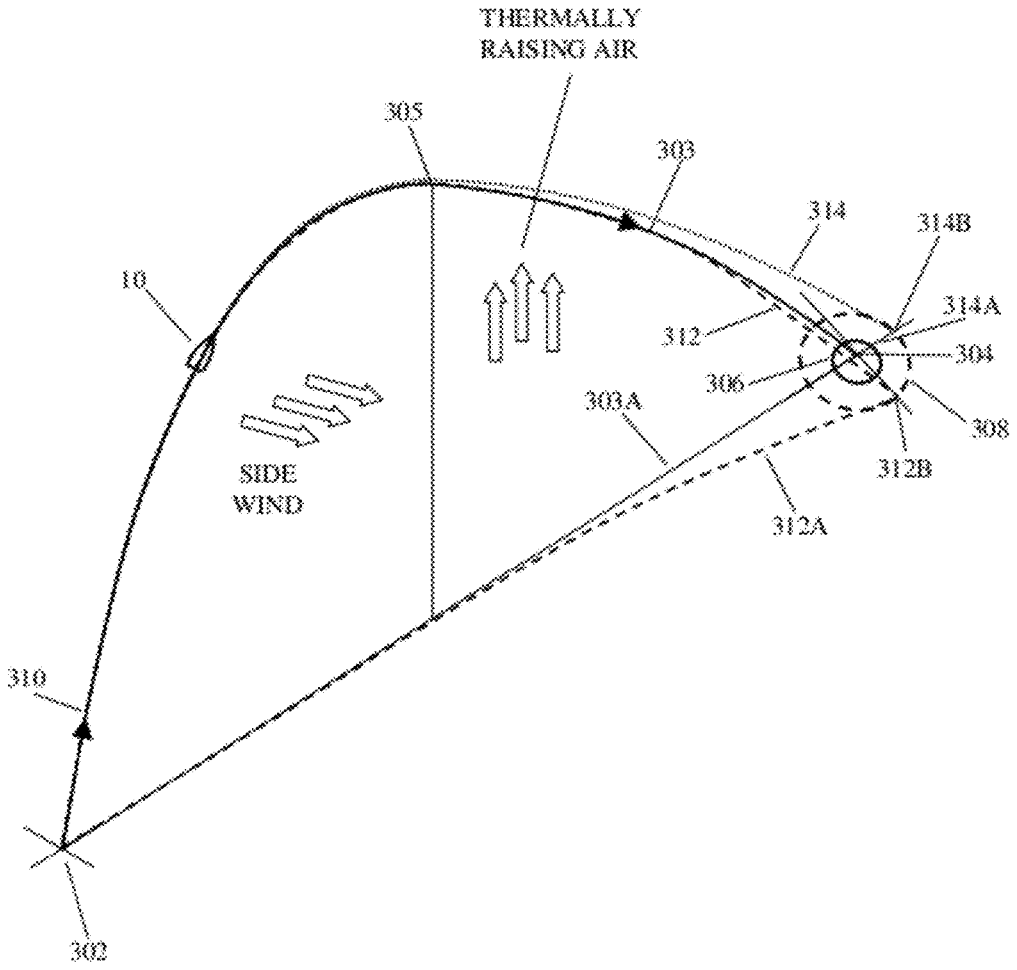
FIG. 3 is a schematic illustration of a trajectory of an artillery shell shot from an origin point towards target point, according to embodiments of the present invention.

Reference is made now to FIG. 3, which is a schematic illustration of the trajectory 310 of an artillery shell shot from an origin point 302 towards target point 304, according to embodiments of the present invention. When no distracting forces, such as winds, turbulences, etc., affect the trajectory of the artillery shell, or any errors in the initial conditions of the trajectory such as gun elevation and azimuth angles or shell initial velocity errors are present, it will travel along trajectory 303 drawn in solid line, passing through apex point 305. When side force acting on artillery shell 10, such as a side wind, the trajectory may be drifted, e.g. to the right, as exemplified by sideways-drifted trajectory 312 drawn in dashed line, having a vertical projection on the ground drawn by dashed line 312A and hitting point 312B. When elevation force acting on artillery shell 10, such as a thermally raising air, the trajectory may be drifted, e.g. upwardly, as exemplified by upwardly-drifted trajectory 314 drawn in dotted line, having a vertical projection on the ground drawn by dotted line 314A and hitting point 314B.

Guiding device 14 (not shown in FIG. 3, but is similar to guiding device 14 described with respect to FIGS. 1B, 1C, 2A and 2B) of artillery shell 10 may be equipped with a guiding system which may comprise a location identifier, such as a global positioning system (GPS), and be loaded, prior to the shooting of artillery shell 10, with the 3-dimensional set of coordinates of the desired hitting point. The guiding system may calculate, continuously, intermittently or otherwise, the deviation of artillery shell 10 from a desired trajectory and may provide correction instructions aimed to return artillery shell 10 to a desired trajectory, to direct artillery shell 10 again to hitting point 304, or any other desired method of trajectory error correction. Correction instructions may activate, according to embodiments of the invention, lift fins 26 and roll stabilizing fins 28A, 28B so as to return artillery shell to a desired trajectory, to point the momentary velocity vector 29 towards the desired hitting point 304, or any other desired method of guidance, as may be desired. Lift fins 26 and roll stabilizing fins 28A, 28B may be activated as described above, in order to make sideways and/or elevation corrections.

It would be apparent that for practical reasons, a guided artillery shell, such as artillery shell built and activated according to embodiments of the present invention, should be fired with extra energy, e.g. with higher speed, longer range and the like compared with those calculated to accurately hit the target, in order to maintain redundant energy for trajectory corrections. According to embodiments of the present invention, an artillery shell equipped with a guiding device, such as guiding deice 14, will be fired with extra energy calculated to compensate for the expected drag associated with applying trajectory corrections.

Figure 4A:
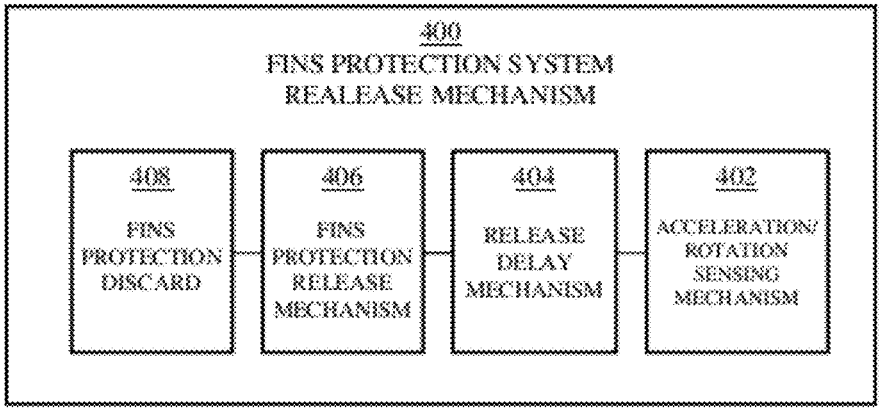
FIG. 4A is a schematic block diagram of safety assembly depicting the operation of the safety assembly, according to embodiments of the present invention.
Figure 4B:
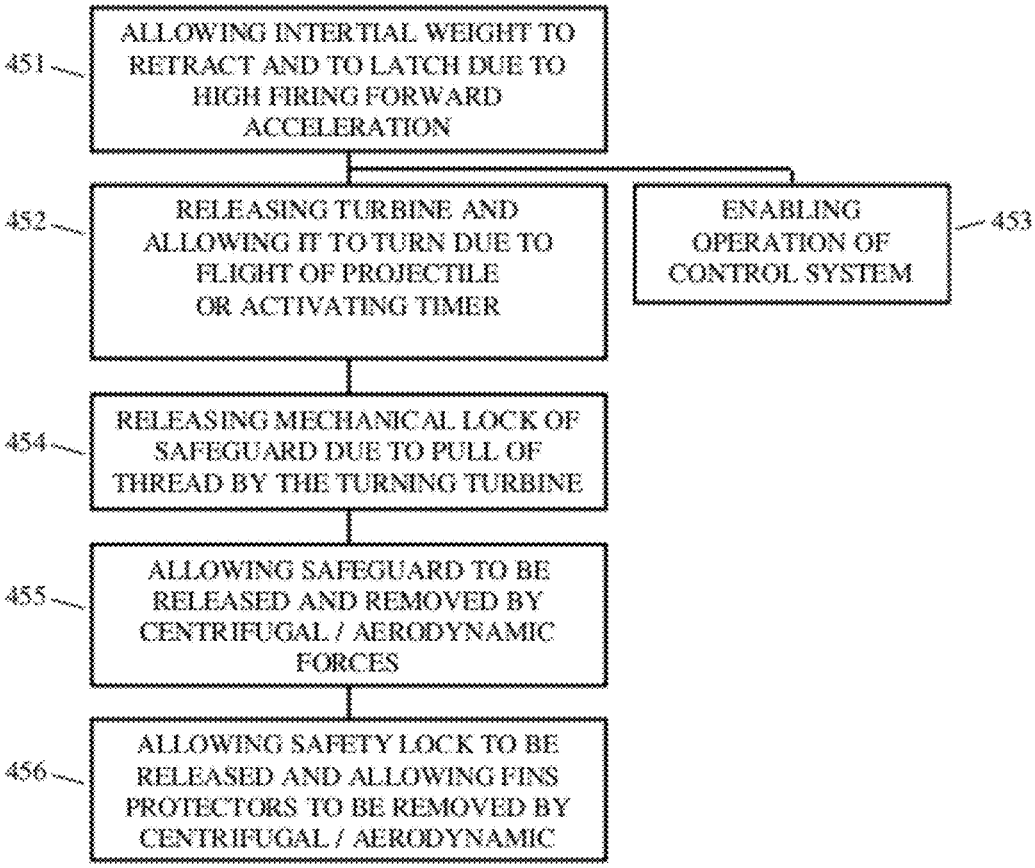
FIG. 4B is a flow diagram depicting the operation of a safety assembly, according to embodiments of the present invention.

Guiding device 14 comprises a mechanism configured to control and keep in safe conditions the detonation means and process of artillery shell 10, as will be explained in details below. Guiding device 14 further comprises protective means to protect fins of guiding device 14 during the stages preceding shooting of artillery shell 10 and until guiding device 14 has gained sufficient distance from the cannon barrel, at which time the fins protection may and should be removed. Accordingly, the fins protective means should be removed shortly after the artillery shell has left the cannon barrel. Reference is made now to FIG. 4A which is a schematic block diagram of safety assembly 400 and to FIG. 4B which is a flow diagram depicting the operation of safety assembly 400, according to embodiments of the present invention. Safety assembly 400 is configured to provide safety during several modes of operation, such as storage, transportation, maintenance, preparations for fire, firing, flight and hit of target. For example, during storage and transportation all assemblies and units should be disabled and safe; during maintenance certain communication and administering of the control system of the guiding device should be allowed, including loading data, tests, etc., however the detonation chain should be disabled and safe and the fins should be covered; during preparations for firing loading of target, trajectory, GPS and other data should be enabled; during firing, the detonation chain and the fins should be kept covered in the first stage, until the artillery shell leaves the cannon barrel and then the fins covers should be removed; after removal of the fins covers, the control system should be enabled and finally when the artillery shell has performed a major part of its flight, the detonation chain should be enabled.

Figure 4C:
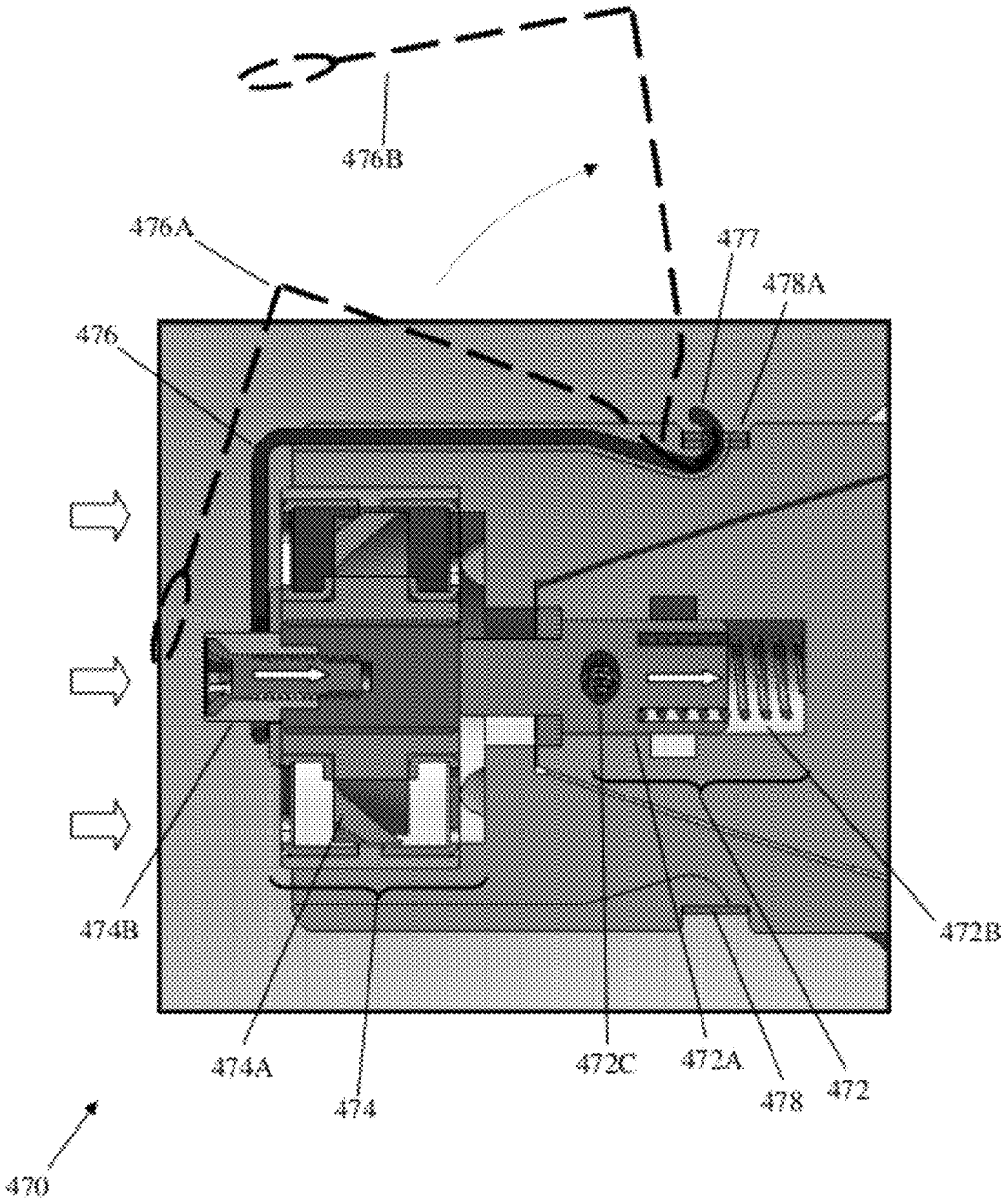
FIG. 4C depicts schematic cross-section illustration of a safety assembly, according to embodiments of the present invention.

Safety assembly 400 comprises acceleration and/or rotation sensing unit 402, release delay mechanism 404, fins protection release mechanism 406 and fins protectors discard 408. Acceleration/rotation sensing unit 402 is configured to keep safety assembly 400 in its safe inactive mode at all times, such as in storage, in transportation, etc., and until actual firing of the artillery shell takes place, and to prevent any accidental or otherwise undesired operating of the control system of guiding device 14 and undesired release of the fins protectors. Acceleration/rotation sensing unit 402 is configured to react to a linear acceleration and/or rotation typical to that occurring during firing of an artillery shell and to enable, once triggered the operation of release delay mechanism 404. Reference is made now also to FIG. 4C, which depicts schematic cross-section illustration of safety assembly 470, according to embodiments of the present invention. Acceleration sensing unit 472 comprising weight 472A, spring 472B and latching mechanism 472C. Acceleration sensing unit 472 is configured to have weight 472A placed in a first position, as in the drawing, corresponding to the safe-inactive mode and to latch the weight in a second position, to the right of the first position in the drawing, which corresponds to the active mode. As seen in FIG. 4C, weight 472A is in its first position due to the pressure applied by spring 472B. When in its first position, weight 472A is in contact with air operable turbine 474A of flight operated unit 474 and thus holding turbine 474A from turning. When weight 472A fully retracts against the force of spring 472B, due to latching mechanism 472C. Latching mechanism 472C may be formed as a springy ring disposed around the perimeter of weight 472A in a respective groove, pressing against the inner wall of the cavity in which weight 472A moves. When weight 472A fully moves under acceleration forces (to the right in FIG. 4C) latching mechanism 472C stretches out into a corresponding notch, thus latching weight 472A in its rear position. Once safety assembly 400 has experienced high forward acceleration, typical to firing of a artillery shell, acceleration unit is allowed to retract to its second position and to be latched in it (block 451). Adequate selection of the physical features of weight 472A (its mass) and spring 472B (its spring factor, length and initial load) of acceleration unit 472 may ensure that weight 472A will change its position from its first (initial) position to its second (terminal) position only subject to experiencing acceleration having magnitude within a defined range of accelerations, typical to the acceleration of a artillery shell when being fired. The movement of weight 472A of acceleration unit 470 backwards with respect to the direction of flight may cause two different actions. First, this movement releases a distance dependent mechanism, such as turbine 474A of flight operated unit 474 installed at the front end of safety assembly 470 and enables its rotation (block 452). Alternatively, that movement of weight 472A may activate a time dependant mechanism, such as a timer (not shown) (block 452). Second, this movement activates a 'start' action which powers and activates the control system of guiding device 14 (block 453). Turbine 474A, being free to rotate, rotates about its axis due to the flow of air as a result of the flight of the artillery shell and pulls, due to its rotation, threaded bolt 474B towards the rear part of the artillery shell (block 454). As a result the head of threaded bolt 474B, being the locking means of mechanical safe-lock means 476 of fins protectors release unit 478, allows fins protectors release unit 478 to be released and thus allowing fins protectors (not shown) to be removed. As seen in FIG. 4C, mechanical safe-lock means 476 is shaped, according to embodiments of the present invention, as a substantially right-angled L shape piece with a semi circle hook shape 477 formed at one end. Hook shape 477 end locks fins protectors release unit 478 by threading two ends of it together. Due to the high speed flow of air and high speed spin of safety assembly 470 together with the artillery shell, mechanical safe-lock means 476 is drawn away from safety assembly 470, as depicted by the mid-positions of safe-lock means 476 shown by dashed line images 476A and 476B, showing two consecutive positions of safe-lock means 476 when it is released. Following that, for similar effects, fins protectors release unit 478 is drawn away from safe-lock means 476 (block 456) and as a result allowing fins protectors to be drawn away from guiding device 14.

Figure 4D:
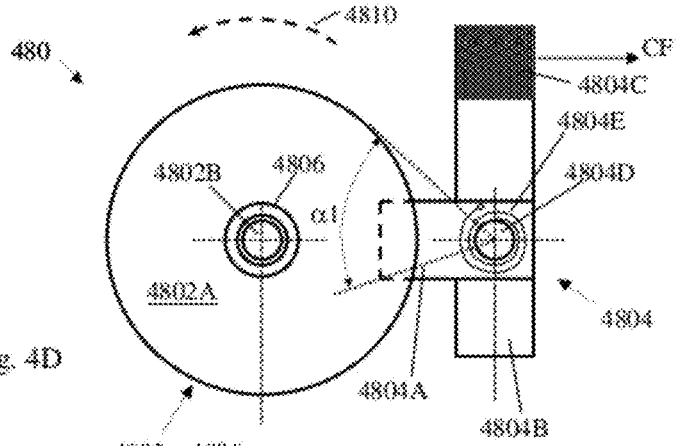
FIG. 4D is a schematic top-view illustration of a second embodiment of a safety assembly according to embodiments of the present invention.
Figure 4H:
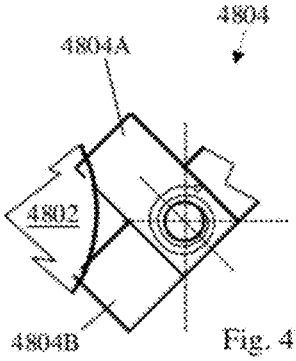
FIG. 4H is a schematic partial top-view illustration of the second embodiment of the safety assembly in a mid-position between first and second stage, according to embodiments of the present invention.
Figure 4E:
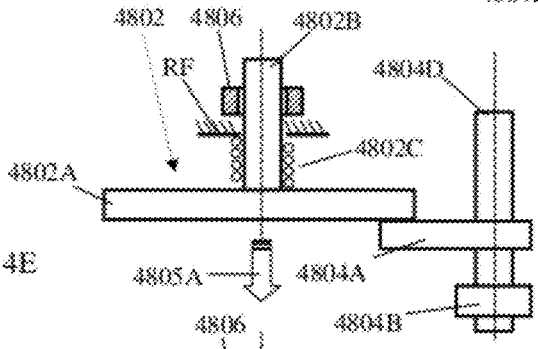
FIGS. 4E, 4G and 4F are schematic pairs of top and side view illustrations of three operational stages, respectively, of the second embodiment of the safety assembly of FIG. 4D, according to embodiments of the present invention.

Reference is made now FIGS. 4D and 4E, which are a schematic top-view and side-view illustrations, respectively, of centrifugal force safety assembly 480, which is part of a second embodiment of a safety assembly according to embodiments of the present invention. Assembly 480 is seen in FIG. 4D from the front end of an artillery shell in which it may be installed. Assembly 480 may substitute flight operated unit 474 in safety assembly 470 of FIG. 4C. Assembly 480 comprises a movable element 4802 comprising an elongated portion 4802B and wider element 4802A connected to each other. Movable element 4802 comprises also spring 4802C that tends to push moveable element 4802 away from reference frame RF, which may be part of a casing of the artillery shell. Spring 4802C is installed so that when movable element 4802 is in an initial position as illustrated in FIG. 4E it is preloaded with expansion force. Movable element 4802 may move in a direction is indicated by arrow 4805A in FIG. 4E. Assembly 480 further comprises ring 4806 which is tied to an operating mechanism (not shown) similarly to part 476B of FIG. 4C. For the sake of simplicity and clarity of the description it is assumed that when elongated portion 4802B is pulled out of ring 4806, the activation of the control and armament of the systems of an artillery shell in which assembly 480 is installed is enabled by releasing ring 4806 from elongated portion 4802B.

Assembly 480 further comprises rotatable element 4804 comprising first protrusion 4804A, second protrusion 4804B, weight 4804C, rotation pivot 4804D and rotation return means 4804E. Rotatable element 4804 may rotate about rotation pivot 4804D in a clockwise direction for example when weight 4804C is subject to a centrifugal force CF. Rotatable element 4804 may be returned in a anti-clockwise direction by rotation return means 4804E when the returning force of return means 4804E is greater than centrifugal force CF. The returning force of spring 4804E and the weight of weight 4804C may be set so that the centrifugal force attempting to turn rotatable element 4804 in clockwise direction and the returning force have an equal magnitude in an angular speed AS, indicated by arrow 4810, of value $AS_{BAL}$. It would be apparent to one skilled in the art that the direction of AS 4810 may be clockwise or anti-clockwise with similar effect with respect to CF. Angular speed AS 4810 occur when an artillery shell in which assembly 480 is installed spins about its longitudinal axis when it is shot and later when in flight. The magnitude of AS 4810 changes in this period of time. Angular speed AS 4810 rapidly accelerates to the range of 5,000 RPM to 20,000 RPM during firing when the artillery shell is in the cannon barrel and then the fuze's front portion angular speed drops rather quickly when the artillery shell is in flight in the air, down to substantially zero controllable via the aerodynamic shape of the fuze and the control fins. FIGS. 4D and 4E present assembly 480 in its first operational stage, which is typical for the periods when an artillery shell having assembly 480 is prior shooting. As seen in FIG. 4E movable element 4802 is secured by protrusion 4804A from moving away from reference frame RF by the preloaded force of spring 4802C.

Figure 4F:
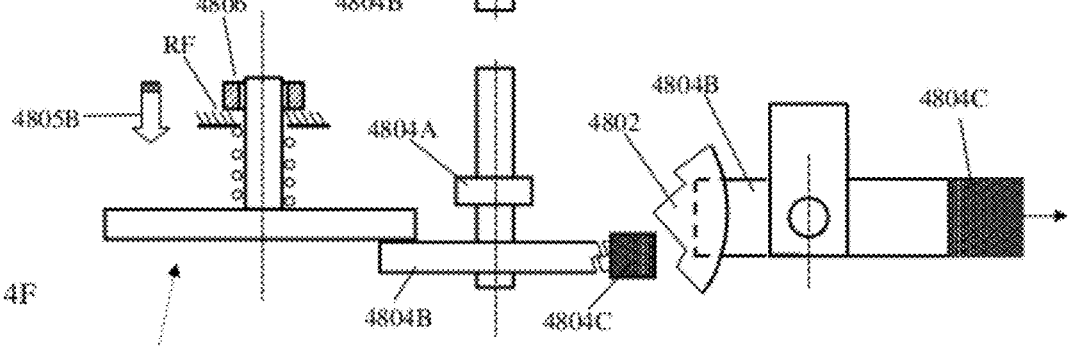
Figure 4G:
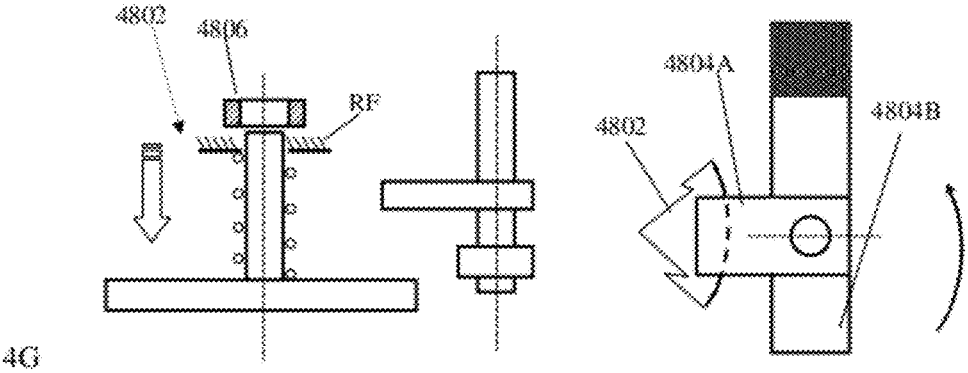

Reference is made now to FIGS. 4F and 4G which are pairs of schematic top and side view illustrations, respectively, of two operational stages, respectively, of the second embodiment of the safety assembly of FIG. 4D, according to embodiments of the present invention. A second operational stage of assembly 480 is depicted in FIG. 4F. When angular speed AS 4810 of assembly 480 reaches values greater than $AS_{BAL}$, centrifugal force CF, acting on rotatable element 4804, causes rotatable element 4804 to rotate so that weight 4804C gains a growing distance from the center of rotation of angular speed AS 4810 (turn in clockwise direction in the example of FIGS. 4D, 4E and 4F). When rotatable element 4804 starts rotating protrusion 4804A slides over the bottom face of element 4802A while still preventing element 4802 from moving away from reference frame RF. When the total angular displacement of rotatable element 4804 is greater than angle $\alpha 1$, protrusion 4804A slides off the outer circumference of element 4802A, and movable element 4802 is free to move away from reference frame RF (in the direction of arrow 4805A) till it is stopped by protrusion 4804B, which is now placed against movable element 4802 due to the rotation of rotatable element 4804.

Reference is now made also to FIG. 4H, which is a partial top-view illustration of assembly 480 of the second embodiment of a safety assembly in a mid-position between first and second stage, according to embodiments of the present invention. As is shown in FIG. 4H, protrusion 4804B is shaped so that before rotatable element 4804 has reached a rotation angle equal to $\alpha 1$, a portion of protrusion 4804B is located under movable element 4802 thus securing movable element 4802 from moving over protrusion 4804B when rotation angle $\alpha 1$ has been reached.

As long as angular speed AS 4810 is kept above $AS_{BAL}$, the angular rotational displacement angle of rotatable element 4804 about pivot from 4804D its rest position is kept greater than $\alpha 1$, protrusion 4804B is placed, at least partially, against movable element 4802 and thus preventing its movement further away from reference frame RF. Accordingly, movable element 4802 is kept in a position corresponding to the second operational stage of assembly 480, a stage that is identified by a respectively high spinning speed that follows a zero (or a very low) spinning speed.

Reference is made now also to FIG. 4G, which depicts the status of assembly 480 in its third operational stage after it has left the cannon barrel, and aerodynamic forces acting on the fuze's fins cause rapid deceleration of the rotation speed AS of the fuze. As a result of the deceleration of AS 4810 when the magnitude of AS 4810 drops below $AS_{BAL}$, the returning force of returning mechanism 4804E defeats centrifugal force CF and rotatable element 4804 starts rotating back towards its rest position, in an anti clockwise direction in FIG. 4G. When protrusion 4804B completely leaves the circumference of element 4802A. At this stage movable element 4802 is free to move, due to the action of preloaded spring 4802C yet farther from reference frame RF until ring 4806 is released and, as a result, activation of control and armament of artillery shell and/or release of fins protection system is enabled.

Figure 4I:
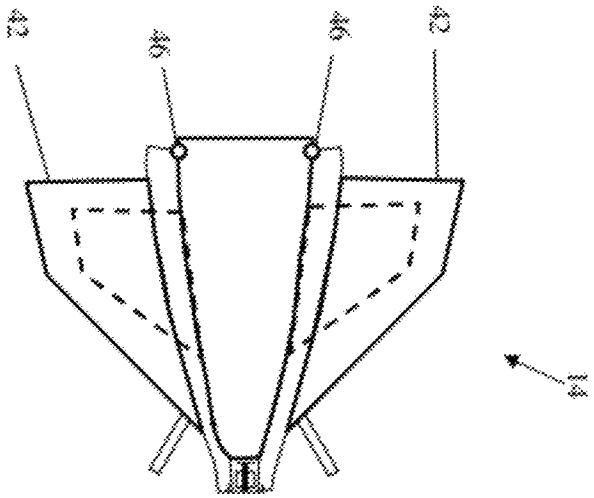
FIGS. 4I and 4J are schematic illustrations of fins protectors of a guiding device, in protecting position, and during removal from guiding device 14, respectively, according to embodiments of the present invention.
Figure 4J:
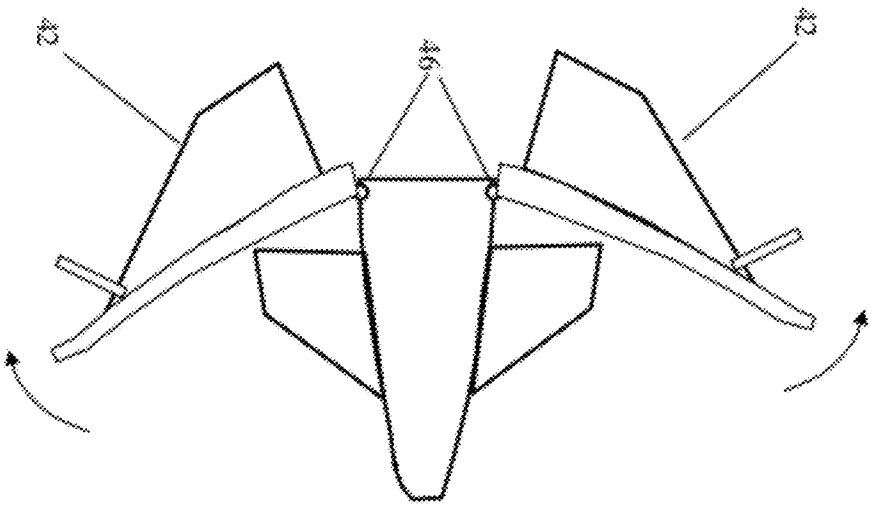

Reference is made now to FIGS. 41 and 4J, which are schematic illustrations of fins protectors 42 of guiding device 14, in protecting position, and during removal from guiding device 14, respectively. As long as fins protectors release unit 478 (FIG. 4C) is locked, fins protectors 42 are kept in their protecting position (FIG. 4I). Once fins protectors release unit 478 is released, fins protectors 42 are free to be drawn away from guiding device 14, according to similar effects as described above and thus to turn about their rear pivoting point 46 and, when reaching certain, high enough, angle with respect to guiding device 14, to be fully released from guiding device 14. According to alternative embodiment, fins protectors 42 may be formed as slices of a dome (not built tightly around the fins), which are operated in a similar manner when release unit 478 is released to get apart and be drawn away from guiding device 14.

Figure 5A:
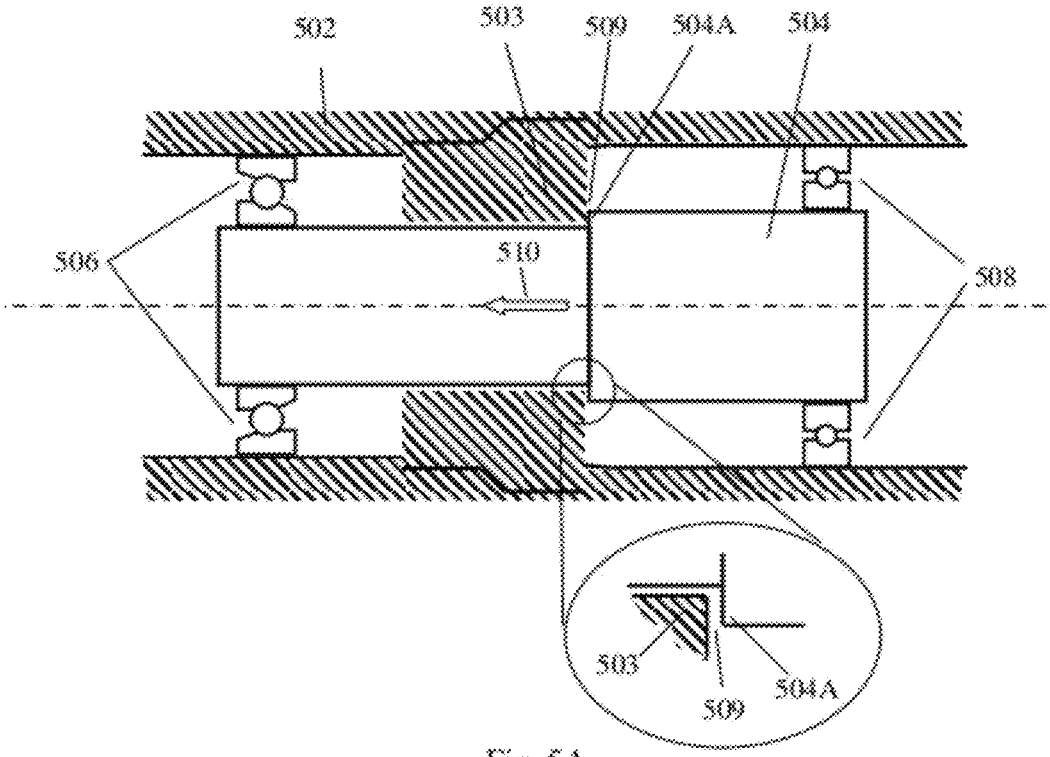
FIGS. 5A, 5B and 5C schematically depict bearing support of a guiding device to a body of an artillery shell, enlarged view of one bearing in normal operation position and in position when the guiding device is under high linear acceleration forces, respectively, according to embodiments of the present invention.
Figures 5B, 5C:
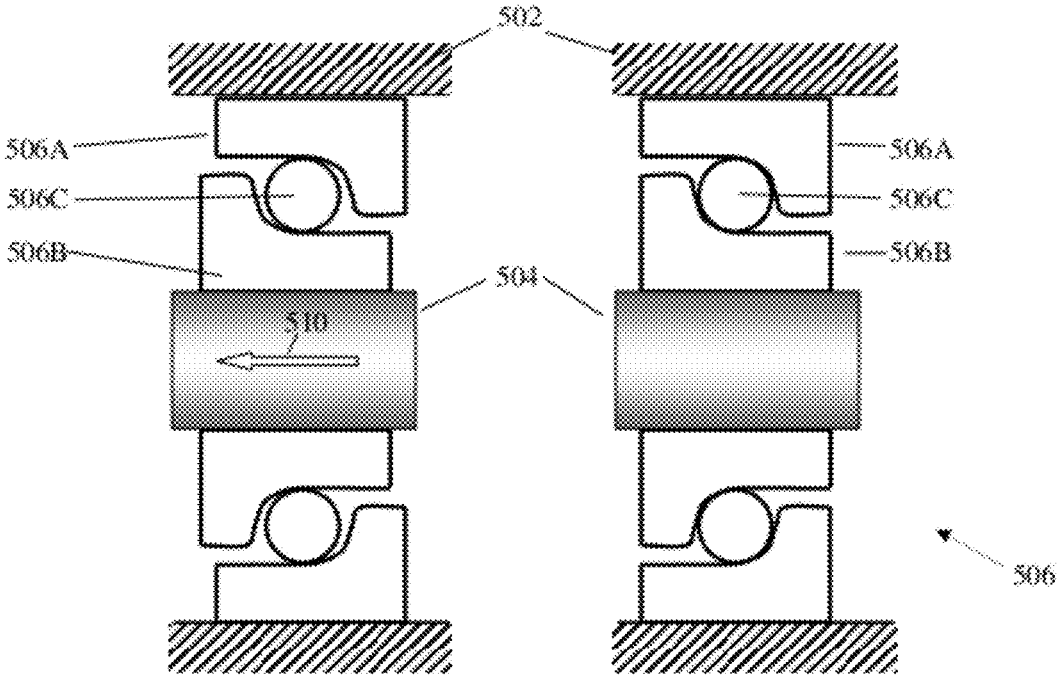

Reference is made now to FIGS. 5A, 5B and 5C, which schematically depict bearing support of guiding device 14 to the body of artillery shell 10, enlarged view of one bearing in normal operation position and in position when guiding device 14 is under high linear acceleration forces, respectively, according to embodiments of the present invention. Guiding device 14 (not shown here) may be supported, via its central axis 504 to the body 502 of artillery shell 10 via two or more bearings 506, 508. A circumferential inner protrusion 503 is made inside body 502. Rim 504A at one end of central axis 504 is adapted to partially overlap with protrusion 503 with a small gap 509 between them. Gap 509 may get smaller until it is fully closed when central axis 504 slides towards the left of FIG. 5A. An enlarged partial view of protrusion 503, rim 504A and gap 509 is seen on the lower-left corner of FIG. 5A. Bearings 506, 508 may be of the angular contact ball bearing type which allows axial movement, as depicted by arrow 510. During normal operation of bearings 506, 508 they provide rotational support that enables axis 504 of guiding device 14 to turn with respect to the body of artillery shell 10 in speeds of magnitude of order of 20,000 rounds per minute (RPM). Angular contact ball bearings need to be set for such rotational speeds by properly setting their constant axial load. During firing of artillery shell 10 bearings 506, 508 are subject to very high axial accelerations, as high as 20,000 g factor. The special formation of contact ball bearings 506, 508, as shown schematically in FIG. 5C, allows axis 504 to slightly move to the left of the drawing with respect to body 502, thus releasing the load off balls 506C of ball bearing 506, and preventing damage to the bearing. At this stage, the full load of axis 504 is carried by protrusion 503, allowing only a small movement by designing a small gap 509 between axis 504 and protrusion 503, which are part of the external structure 502. At such situation a high friction of axis 504 with respect to body 502 is expected. In another embodiment of the bearing support unit, a bearing is inserted into gap 509 (not shown) in order to reduce the friction. When the acceleration drops sharply, for example when artillery shell 10 emerges from the cannon barrel, axis 504 returns to its normal position allowing bearings 506, 508 to perform their role. Returning of central axis 504 is performed by a spring inserted into gap 509 (not shown), either with or without additional bearings inserted to reduce friction.

Figure 6:
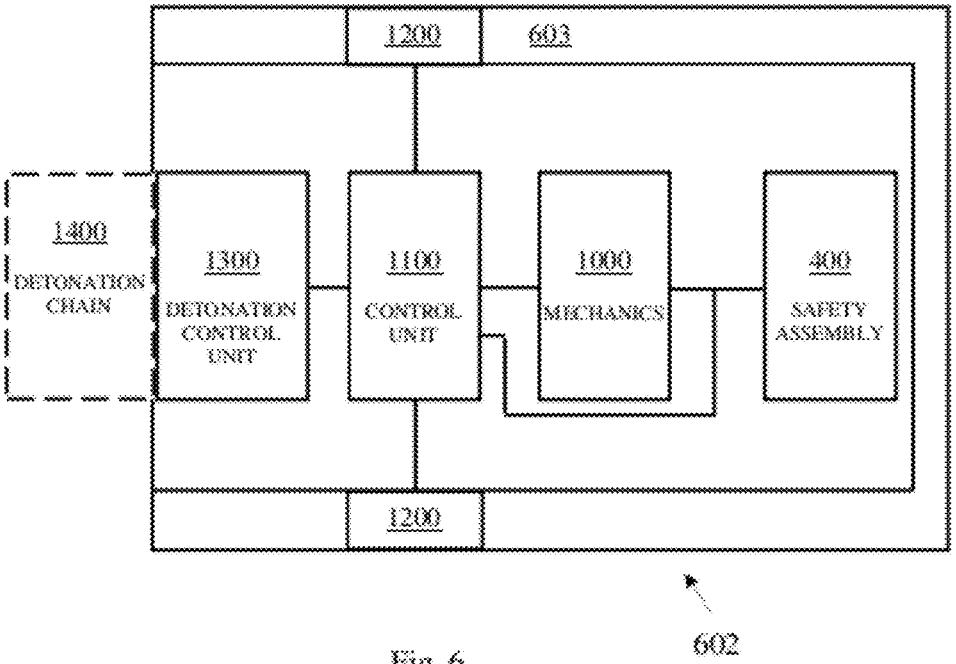
FIG. 6 is a schematic block diagram of a guiding device according to embodiments of the present invention.

Reference is made now to FIG. 6, which is a schematic block diagram of guiding device 602, according to embodiments of the present invention. Guiding device 602 may comprise safety assembly 400, mechanical system 1000, control system 1100, multi-purpose set of antennas 1200, detonation unit 1300 which activates detonation chain 1400. Safety assembly 400 was described above and in accordance with that description it provides safety at certain conditions enables operation of control system 1100 and releases fins protectors after firing. Mechanical system 1000 may comprise power units, such as electrical motors, for setting the angle of attack of the fins, assemblies of rods, levers and pivots for conveying movements from the motors to the fins, bearings, such as bearings 506 and 508, for providing rotatable support for guiding device 14, mechanical steady support for power source, such as batteries, for electronic cards, and the like. Control system 1100 may comprise units for receiving location indication, such as GPS signals, for calculating momentary location and comparing to a respective desired location and for producing correction controls calculated for returning artillery shell 10 to its desired trajectory. Control system 1100 may comprise storage means for storing executable code that when operated in a CPU of control; system 1100 can perform the navigation and detonation control assignments. Control system 1100 is connected to a set of multipurpose antennas 1200 which may be used for receiving GPS or other navigation signals and providing them to control system 1100; for receiving pre-firing communication, such as for uploading target data; and for transmitting and receiving of signals used for range/proximity measurement.

Detonation control unit 1300 is designed to receive detonation commands and parameters from control system 1100, and for providing detonation signal according to these parameters. Detonation parameters may be, for example, whether the fuse should be activated before hitting of the target, while hitting the target or certain time after hitting the target. Other detonation parameters may be time of flight, height of burst, and self-destruct. Detonation control unit 1300 is located at a place in guiding device 14 which provides it with good mechanical protection from damages to guiding device 14 that are expected due to hitting of the target. Accordingly detonation control unit 1300 is also equipped with a dedicated power source, such as one or more capacitors, that may ensure sufficient supply of power even if the main power source, such as batteries, is destroyed or otherwise disabled when artillery shell 10 hits the target or any other body. Detonation control unit 1300 is in operational connection with detonation chain 1400, which may be any regular artillery shell detonation chain. Detonation control unit 1300 is held firmly with control system 1100, safety assembly 400 and antennas 1200, thus eliminating connection issues that may arise from connecting rotating parts. However, detonation control unit, therefore, rotates with respect to detonation chain 1400. In order to allow free rotation of guiding device 14 with respect to the body and envelope of artillery shell 10, activation of detonation chain 1400 is done by the explosion of a small detonator that is connected to detonation control unit 1300 and located in close proximity to detonation chain 1400 so that it is free to rotate with respect to detonation chain 1400, using the fact that detonation is not affected by relative rotation of its parts.

Antennas 1200 are made of at least one receiving element and a radome. The receiving elements are electrically and mechanically connected to control system 1100 and mechanical system 1000. The radomes are structurally connected to cone 603 in such a way that allows installation of antennas 1200 as one body with mechanical system 1000 and control system 1100, taking advantage of the conical-like shape cone 603 of the main envelope of guiding device 14, which allows insertion antennas 1200 with mechanical system 1000 and control system 1200 until receiving elements of antennas 1200 fit their position inside their respective radomes, thus saving complicated installation operation and excess connectors.

Figure 7A:
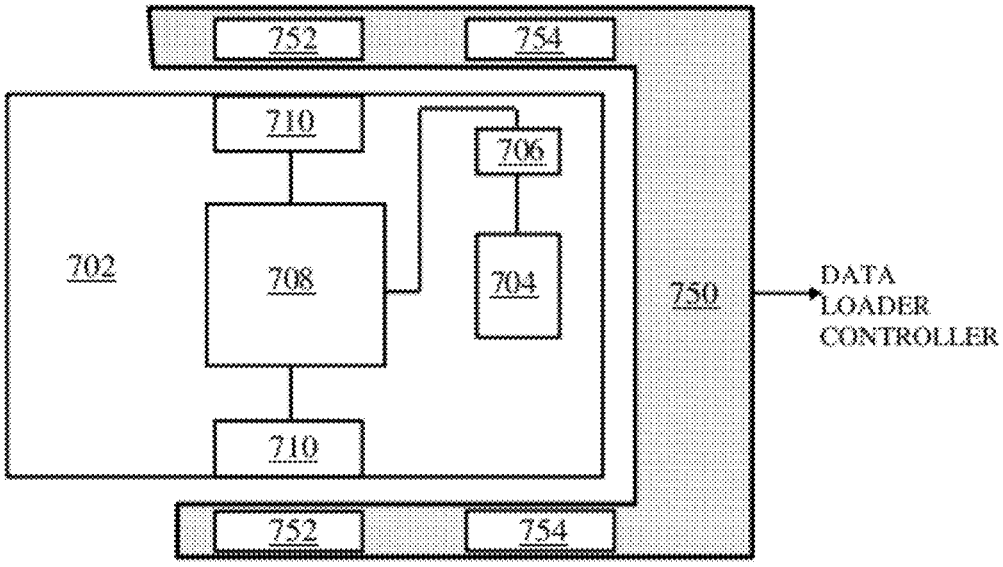
FIG. 7A and 7B are schematic block diagram illustration of a data upload system and of data upload process, respectively, according to embodiments of the present invention.
Figure 7B:
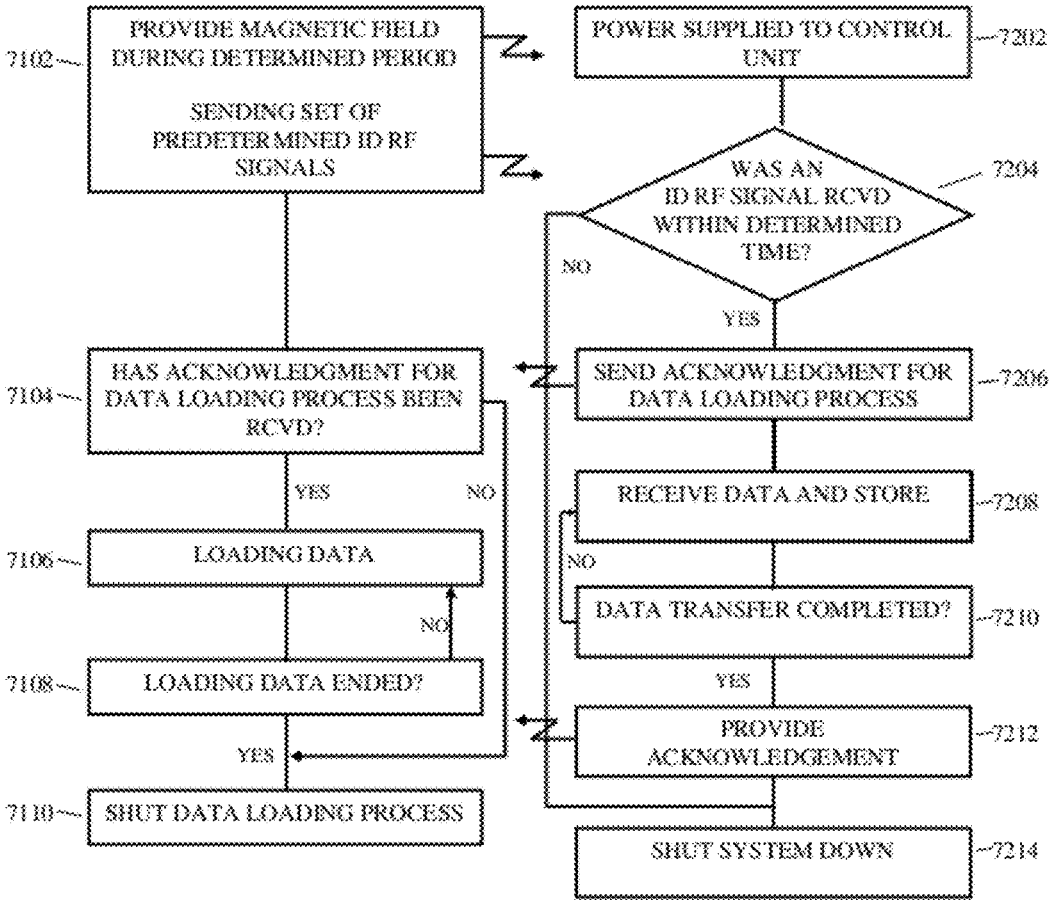

Antennas 1200 may further be used for receiving signals during data upload process. Reference is made now to FIG. 7A and 7B, which are schematic block diagram illustration of data upload system 750 and of data upload process, respectively, according to embodiments of the present invention. Data upload system 750 may be shaped so as to form a cap that substantially surrounds guiding device 702, or at lest a frontal tip of same, when placed proximal to it, thus forming a Faraday cage which ensures RF and magnetic fields isolation from the environment. According to embodiments of the present invention the shape of device 702 may have a specific, special form and the frontal tip of guiding device 702 may be formed as a compatible shape, to ensure that only the specific shape of frontal end of device 702 may be inserted into the cap-shaped system 750. Data upload system 750 may comprise at least one antenna 752 for sending/receiving RF signals and at least one magnetic field generator 754. The operation of data upload system 750 may be controlled by a data loader controller (not shown), which may control the signals transmitted from antennas 752 and the generation of magnetic field by magnetic field generator 754. Guiding device 702 may comprise at least one antenna 710, such as antennas 1200 of FIG. 6, power source 704 and magnetically operable reed switch connected between power source 704 and control unit 708. FIG. 7B depicts a flow diagram of a process of data uploading to guiding device 702 in which the left branch of the flow diagram depicts the stages of the process occurring in data upload system 750 and the right branch depicts the stages of process occurring in guiding device 702. Data upload process is initiated by placing data upload system 750 adjacent to guiding device 702 so that its portion where antennas 710 are installed is substantially comprised inside data upload system 750. A magnetic field is provided to activate reed switch 706 (block 7102) thus providing power from power source 704 to the data upload section of control unit 708. Substantially concurrently a RF signal is transmitted towards antennas 710 for a pre-defined short period of time (block 7102). If the received RF signal occurs within a predefined time slot and optionally if the received pattern of the RF signal matches an expected pattern stored in guiding device 702 (block 7204) an acknowledgment signal is sent to data upload device (block 7206, block 7104). Further, the data is transmitted (blocks 7106, 7108) and is received by guiding device 702 (blocks 7208, 7210), until a End of Transmission is identified and transmitted by guiding device 702 (block 7212) and received by data upload system 750 (block 7108) and the data uploading process safely terminates. Thus, two conditions should prove true—a magnetic field, typically very strong, to ensure high immunity from accidental magnetic fields, and a RF signal which occur within a predetermined time slot, and match a predefined signal pattern. According to embodiments of the present invention, and as indicated above, transmission of signals between data upload system 750 and guiding device 702 may be carried out using at least one antenna comprised in guiding device 702, which is adapted to serve for other purpose(s). For example, antenna 1200 (FIG. 6) may be a multi-purpose antenna and as such may be used as a receiving antenna for the receipt of GPS signals. That antenna may also be used for the purposes of communication between guiding device 702 and data upload system 750. According to yet another embodiment communication between guiding device 702 and data upload system 750 may be carried out via Infra Red (IR) communication channel, at which case an improved level of immunity against undesired malicious intervention in the communication may be achieved due to the high dependency of IR communication on the existence of line of sight between the communicating parties.

Figure 8A:
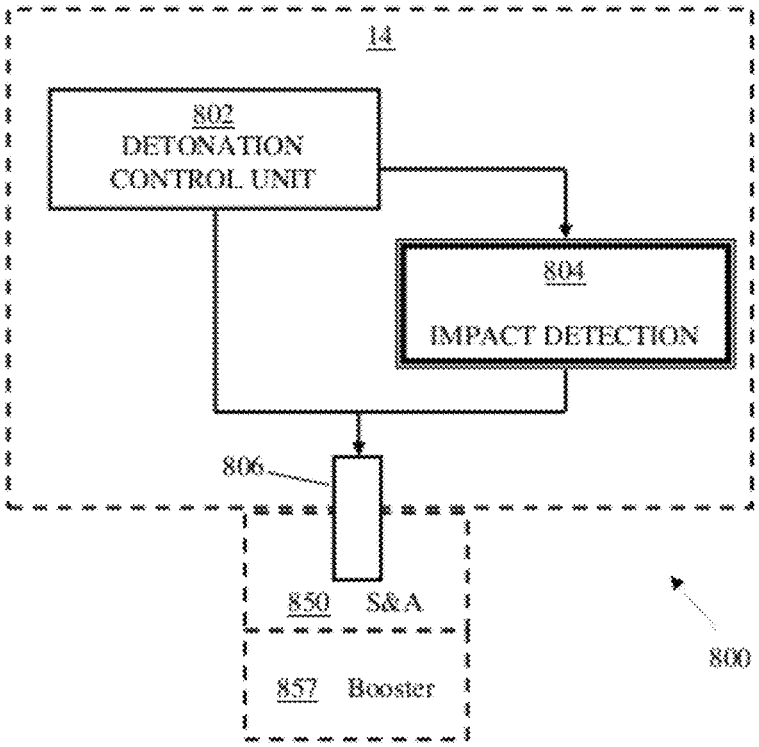
FIGS. 8A and 8B schematically depict a detonation subsystem and method, respectively, for activating an artillery shell, whether before, at or after the impact of the shell, according to embodiments of the present invention.
Figure 8B:
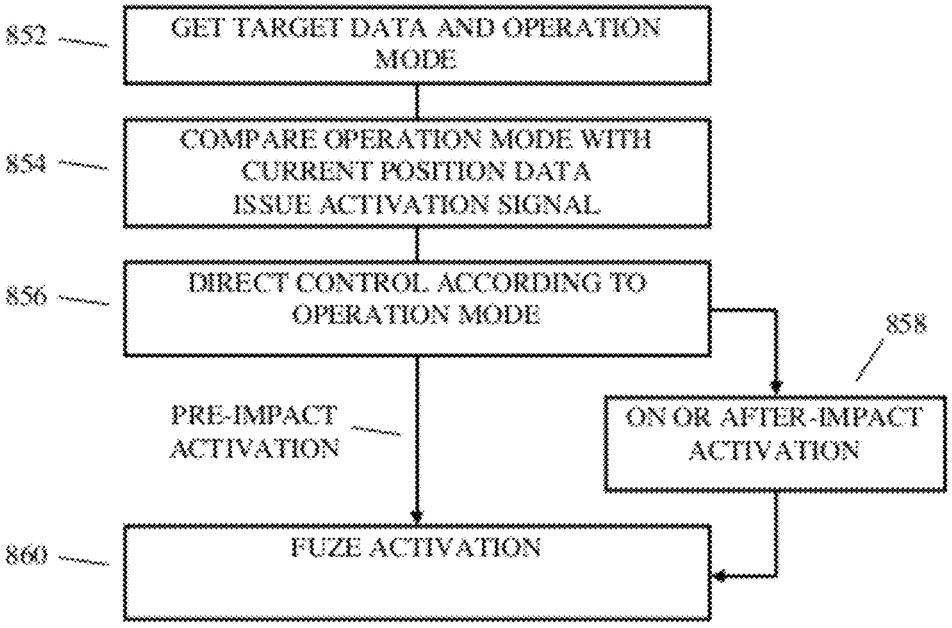

Reference is made now to FIGS. 8A and 8B, which schematically depict detonation sub-system 800 and method, respectively, for activating the artillery shell, whether before, at or after the impact of the shell, according to embodiments of the present invention. As part of a guiding device, such as guiding device 14, detonation sub-system 800 for activating the artillery shell, such as artillery shell 10 may comprise detonation control unit 802, impact detection unit 804 and electrical detonator unit 806. Control unit 802 may be adapted for receiving target data and mode of operation data, for example before shooting of the artillery shell, for calculating momentary location when mode of operation dictates location-dependent operation, such as proximity or above-terrain activation and for redirecting control of the detonation to impact detection unit 804 in case of on or after impact detonation. Detonation control unit 802 may be part of, or included in control unit 1100 (of FIG. 6), yet detonation control unit 802 may be embodied, according to other embodiment of the invention, as a stand-alone unit or as part of another electronic unit. It will be apparent to those skilled in the art that while functions that have to be performed prior to the impact of the artillery shell on the target may be embodied in hardware, firmware, software or any combination thereof that do not necessarily have to be impact-proof. However, functionalities that have to be performed upon impact or after impact, such as delayed activation of the artillery shell, must be controlled by a durable control unit, that should be able to function even after an impact of the artillery shell on ground or other target or target vicinity. According to embodiments of the present invention impact detection unit 804 may be built and housed so as to survive the physics of an impact of a artillery shell when hitting a target, thus ensuring that on impact or post impact functionalities will be supported and carried out. According to embodiments of the present invention impact detection unit 804 may be triggered, or armed, by detonation control unit, when on impact or post impact activation is required and remain unarmed at all other times. Accordingly, the operation of detonation sub-system 800 comprises getting target data and operation mode (block 852), such as target location, mode of detonation, etc. This stage may typically be performed long time before the shooting of the artillery shell or shortly before, however the essential data must be loaded prior to the shooting itself. After shooting and during flight of the artillery shell detonation control unit 802 may compare current coordinates and other current data with the data required for activating the detonation (block 854). When the artillery shell approaches the point where detonation mechanism should be ready the control process proceeds according to the mode of detonation, as dictated at block 852. When the mode of detonation is a pre-impact mode, for example detonation should take place when the artillery shell is above the target by a pre-defined distance or height, control remains with detonation control unit 802. Based on the momentary location and possibly other data, detonation control unit will activate electrical detonator 806 (block 860), which, in turn will activate the explosive of the artillery shell. This mode of operation is also relevant for self-destruction operation, if detonation control unit 802 detects that the artillery shell is too far from the designated target and must be destroyed. In another mode, for example on-impact or post-impact detonation, control of the detonation activation is directed to impact detection unit 804 (block 858), which in turn, and typically on or after impact, activates detonator 806 and then the explosive of the artillery shell. For improved safety impact detection unit 804 may be disarmed and unpowered until the detonation control is directed to it. The activation of impact detection unit may comprise charging a power source, such as a capacitor, that will provide the power required for the operation impact detection unit 804. Additionally, if data needs to be provided from detonation control unit 802, it may be provided at this stage as well. As described above, impact detection unit 804 may be built and housed so to survive the impact of the artillery shell on, or next to the target. Thus, once control of the detonation has been directed to smashing unit 804, it will be governed by this unit, as dictated by the initial detonation data. It will be noted that detonation control unit 802, impact detection unit 804 and detonator 806 are typically part of guiding device 14 and as such may rotate with respect to the artillery shell body. A Safe and Arm (S&A) unit 850 is adapted to enable the detonation to reach the shell's explosives only when a pre-determined set of conditions has been met. For example minimal level of linear acceleration, typical of firing conditions, and minimal number of rotations of the shell which ensures that the shell gained certain safety distance from the cannon, has been met. Booster section 857 is responsible for increasing the detonation effect so as to enable the detonation of the shell's explosive. S&A unit 850 and booster unit 857 are typically a standard set of safe and arm and booster units, which may be stationary with respect to the body of the artillery shell. Thus, detonator 806 is rotating with respect to S&A 850. According to embodiments of the invention detonator 806 may be formed as a cylindrical body which is placed in close proximity to S&A unit 850 so that it may turn freely close to it. While mechanically detonator 806 and S&A unit 850 are disengaged, the detonation of detonator 806 is sufficient to detonate S&A unit 850 and booster unit 857. This enables the use of a standard safe and arm unit that requires rotation as a safety measure, and thus prevent costly development and proof of a new S&A unit.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An apparatus comprising:

a front portion and a rear portion, wherein said front portion and said rear portion are connected to each other via bearing arrangement and have a common longitudinal axis, said bearing arrangement allowing turning of said front portion and said rear portion with respect to each other; and one pair of lift fins adapted to be turned by a first driving mechanism and one pair of roll stabilizing fins adapted to be turned by a second driving mechanism, the pairs of fins being connected onto the outer face of said front portion and extending radially from it, wherein the first driving mechanism is adapted to control a value of an angle of attack for the pair of lift fins and the second driving mechanism is adapted to control a value of an angle of attack for the pair of stabilization fins, wherein the angles of attack of said fins are adapted to be changed provide, when in flight, a roll angle to direct lift force to cause said apparatus to guide a cannon shell to which it is attached along a required flight trajectory, wherein at least some of the fins are further adapted to rotate about an axis perpendicular to a longitudinal axis of the front unit, and wherein the cannon shell is configured to spin about its longitudinal axis during flight of said cannon shell.

2. The apparatus of claim 1 further comprising:

a guiding system to control the change of said angles of attack of said roll stabilizing fins and of said lift guiding fins; and a location identifier to provide position indication to said guiding system.

3. The apparatus of claim 1, wherein said front portion comprising detonation control unit comprising a detonator connected to, and adapted to be activated by the detonation control unit and said rear portion comprising detonation chain, wherein said detonator is adapted to activate the detonation chain when activated by the detonation control unit, thus enabling activation of a detonation operation while allowing free rotation of said detonation control unit with respect to said detonation chain.

4. The apparatus of claim 1 wherein said bearing arrangement comprising:

at least two bearings of which at least one is a contact ball bearing;

wherein said at least one contact ball bearing is installed so that when said cannon shell is subject to firing acceleration said contact ball bearing is pushed from its normal operation position to a released position to minimize axial pressures on the contact ball bearing.

5. The apparatus of claim 4 further comprising a protrusion in a body of said rear portion and a rim made in said front portion said protrusion and said rim partially overlapping each other and separated from each other by a small gap, said gap is adapted to fully close when said cannon shell is subject to firing acceleration, thus providing axial support from said rear portion to said front portion during said acceleration and preventing damage to said bearings.

6. The apparatus of claim 2 further comprising at least one antenna coupled to the location identifier adapted to receive signals indicative of the location of said apparatus.

7. The apparatus of claim 6 wherein said at least one antenna is further adapted to receive signals from a data loader, said signals representing at least data or control commands.

8. The apparatus of claim 6 further comprising a magnetically operable reed switch adapted to enable activation of data loading circuitry when exposed to a magnetic field of strength higher than a defined level.

9. The apparatus of claim 1, wherein each of said pair of fins is adapted to rotate in opposition to the other.

10. The apparatus of claim 1, wherein the control unit commands the second driving mechanism to set the angle of attack of the roll stabilizing fins that causes the front portion to stay at a zero roll angle, wherein the lift fins control a vertical projection of a trajectory.

11. The apparatus of claim 1, wherein the control unit commands the second driving mechanism to set the angle of attack of the roll stabilizing fins that causes the front portion to deviate from a zero roll angle, wherein the lift fins control a sideways projection of a trajectory.

12. The apparatus of claim 10, wherein the control unit commands the first driving mechanism to change the angle of attack of the roll stabilizing fins that causes the front portion to deviate from the zero roll angle to a desired roll angle.

13. The apparatus of claim 3, further comprising a small detonator coupled to the detonation control unit, wherein activation of the detonation chain is by an explosion of the small detonator.

14. The apparatus of claim 1, wherein the roll stabilizing fins are configured to apply a turning force on the front portion in opposition to the spin of the cannon shell.

15. The apparatus of claim 14, wherein a spin speed of the front portion is substantially zero.

* * * * *